US005604959A

United States Patent [19]

Bowen

[11] Patent Number: 5,604,959

[45] Date of Patent: Feb. 25, 1997

[54] ICE PACK CLIP

[75] Inventor: Michael L. Bowen, Arlington, Tex.

[73] Assignee: Tecnol Medical Products, Inc., Fort Worth, Tex.

[21] Appl. No.: 535,715

[22] Filed: Sep. 28, 1995

[51] Int. Cl.[6] ..... B65D 77/00

[52] U.S. Cl. ..... 24/30.5 R; 24/543

[58] Field of Search ..... 24/543, 346, 30.5 P, 24/30.5 R

[56] References Cited

U.S. PATENT DOCUMENTS

| | | | |
|---|---|---|---|
| D. 276,596 | 12/1984 | Kisha . | |
| 381,256 | 4/1888 | Martens . | |
| 1,459,735 | 6/1923 | Kraft . | |
| 2,589,577 | 3/1952 | Rosenthal . | |
| 2,898,744 | 8/1959 | Robbins | 62/4 |
| 3,036,506 | 5/1962 | Andresen, Jr. . | |
| 3,095,291 | 6/1963 | Robbins | 62/4 |
| 3,149,943 | 9/1964 | Amador | 62/4 |
| 3,171,184 | 3/1965 | Posse . | |
| 3,247,852 | 4/1966 | Schneider . | |
| 3,461,876 | 8/1969 | Miller, Jr. | 24/543 |
| 3,523,534 | 8/1970 | Nolan . | |
| 3,542,032 | 11/1970 | Spencer, Jr. | 128/399 |
| 3,551,965 | 1/1971 | Gordon . | |
| 3,621,539 | 11/1971 | Ayers . | |
| 3,669,115 | 6/1972 | Melges . | |
| 3,735,765 | 5/1973 | Ichelson . | |
| 3,785,111 | 1/1974 | Pike | 53/14 |
| 3,807,118 | 4/1974 | Pike | 53/14 |
| 3,865,117 | 2/1975 | Perry, III | 128/403 |
| 3,874,042 | 4/1975 | Eddleman et al. . | |
| 3,950,158 | 4/1976 | Gossett | 62/4 |
| 4,038,726 | 8/1977 | Takabayashi . | |
| 4,057,047 | 11/1977 | Gossett | 126/263 |
| 4,212,303 | 7/1980 | Nolan . | |
| 4,275,485 | 6/1981 | Hutchison . | |
| 4,294,582 | 10/1981 | Naslund . | |
| 4,296,529 | 10/1981 | Brown . | |
| 4,347,848 | 9/1982 | Hubbard et al. . | |
| 4,356,599 | 11/1982 | Larson et al. | 24/543 |
| 4,385,950 | 5/1983 | Hubbard et al. . | |
| 4,397,315 | 8/1983 | Patel | 128/403 |
| 4,416,038 | 11/1983 | Morrone, III | 24/543 |
| 4,427,010 | 1/1984 | Marx | 128/402 |
| 4,462,224 | 7/1984 | Dunshee et al. | 62/530 |
| 4,523,353 | 6/1985 | Hubbard et al. . | |
| 4,551,888 | 11/1985 | Beecher . | |
| 4,636,391 | 1/1987 | Pike | 426/106 |
| 4,668,564 | 5/1987 | Orchard | 428/246 |
| 4,834,730 | 5/1989 | Holtermann et al. . | |
| 4,854,760 | 8/1989 | Pike et al. | 401/134 |

(List continued on next page.)

OTHER PUBLICATIONS

Defendant Struckmeyer Corporation's "Memorandum of Points and Authorities in Support of Defendant's Motion for Partial Summary Judgement of Invalidity of Claim 1 of U.S. Patent No. 4,523,353," *Tecnol, Inc. and Tecnol Medical Products, Inc.*, Civil Action No. 3:93–CV2220–T, In the U.S. District Court for the Northern District of Texas, Dallas Division, Jun. 10, 1994.

Plaintiff "Tecnol's Response to Struckmeyer's Motion for Partial Summary Judgement of Invalidity of Claim 1 of U.S. Patent No. 4,523,353," *Tecnol, Inc. and Tecnol Medical Products, Inc.*, Civil Action No. 3:93–CV2220–T, In the U.S. District Court for the Northern District of Texas, Dallas Division, Jun. 30, 1994.

Hollister, Inc., "Drain Clamp" Brochure, Date Unknown, one page.

*Primary Examiner*—Victor N. Sakran
*Attorney, Agent, or Firm*—Baker & Botts, L.L.P.

[57] ABSTRACT

The invention relates to an ice pack clip for sealing an ice bag having a blade, a trough, a hinge and a latch. At the hinge end of the clip, the trough has a cam and the blade has a cam follower surface. At the latch end, the trough has projecting nubs and the blade has laterally extending stops. The cam, cam follower surface, nubs and stops cooperate to prevent longitudinal movement of the blade relative to the trough, even if the hinge should fail. Also, the nubs and stops may serve as a secondary latch to prevent unintentional opening of the latch upon bumping the latch release knob.

5 Claims, 2 Drawing Sheets

U.S. PATENT DOCUMENTS 4,887,335 12/1989 Folkmar .
4,953,550 9/1990 Dunshee ..... 128/403
4,983,172 1/1991 Steer et al. .
5,050,272 9/1991 Robinson et al. .
5,125,133 6/1992 Morrison .
5,356,426 10/1994 Delk et al. .
5,379,489 1/1995 Delk et al. .
5,428,871 7/1995 Iosif ..... 24/543
5,466,251 12/1995 Brunson et al. ..... 607/112

FIG. 3
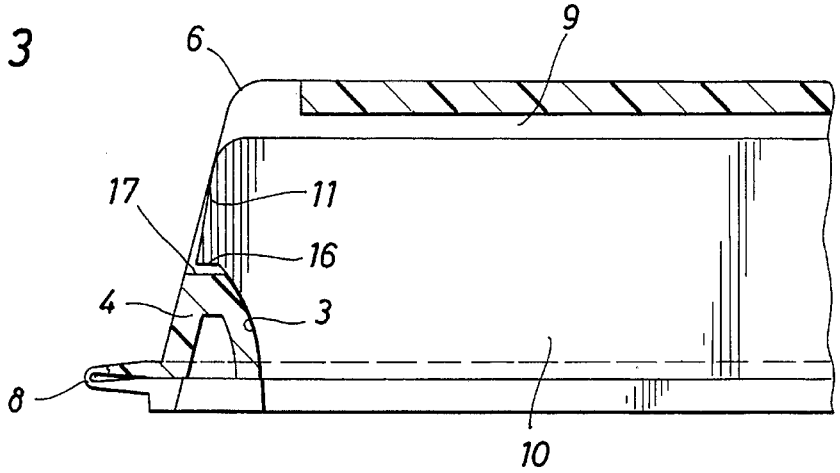
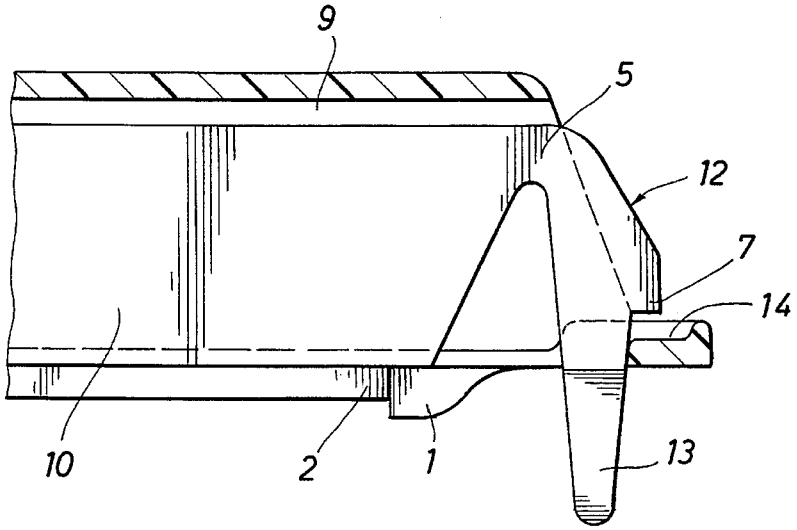
FIG. 4
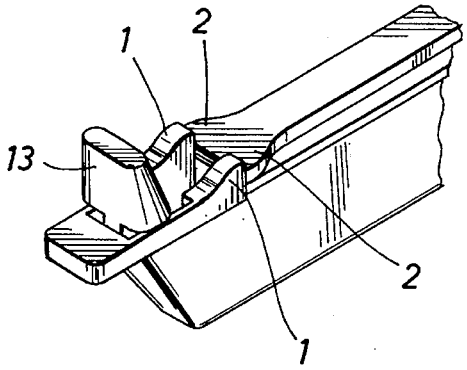
FIG. 5
FIG. 6
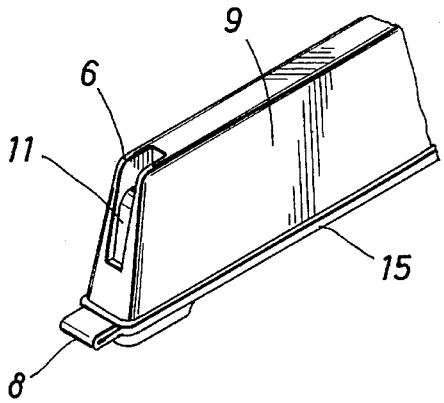

ICE PACK CLIP

TECHNICAL FIELD OF THE INVENTION

This invention relates to a closure device such as an ice pack clip for releasably sealing ice packs and similar flexible open-ended containers. More particularly, this ice pack clip provides a cam and cam follower surface at the clip's hinge end and interlocking hubs and stops at the clip's latch end which together prevent longitudinal movement of the blade in relation to the trough.

BACKGROUND OF THE INVENTION

It is known to seal ice packs used for a variety of purposes with ice pack clips which are generally of the blade and trough (or sheath) type. The known devices generally include a hinge at one end connecting the blade and the trough and a latch at the other end for releasably closing the clip to seal a bag which passes between the trough and the blade when the clip is closed.

Clips or clamps have also been used for a variety of other purposes, including ostomy bags, umbilical cord clamps, etc.

Depending upon the clip or clamp chosen, there are a number of significant shortcomings with the prior art devices, especially for use with ice packs of the type where ice is placed in a plastic bag and the clip is placed about the neck of a plastic bag to seal the ice and water within the bag. These shortcomings include the inability to effectively seal the neck of the bag, teeth or other protrusions which could tear or puncture the plastic bag, resulting in leaks in the immediate use or subsequent uses, and unreliability of clips due to latches unintentionally opening when the latch member is accidentally bumped. Another particular shortcoming of the prior art devices relates to longitudinal movement of the blade within the trough. First, longitudinal movement of the blade in the trough can result in leakage of fluid from the bag. Also, longitudinal movement of the blade within the trough can result in unintentionally releasing the latch. Further, due to the frequent, repeated use of ice pack clips, the hinges frequently fail. When a hinge fails, this exacerbates the problem of longitudinal movement of the blade within the trough as mentioned above, and in many clips results in a total failure of the clip, resulting in release of the blade from the trough and leakage of the contents from the bag.

There exists a need for an ice pack clip with a reliable latch which does not open upon being accidentally bumped. Also, there exists a need for an ice pack clip in which longitudinal movement of the blade relative to the trough is prevented even under the circumstances of the hinge failing. Further, there exists a need for an ice pack clip which maintains its ability to seal an ice bag upon failure of the hinge.

SUMMARY OF THE INVENTION

The invention relates to a closure device for releasably sealing ice packs and similar flexible, open-ended containers. The device includes a blade, a trough, a hinge and a latch, with a cam and a cam follower surface at the hinge end and interlocking nubs and stops at the latch end. The cam, cam follower surface, nubs and stops cooperate to hold the blade in a position of longitudinal stability in relation to the trough. This longitudinal stability overcomes the shortcomings of the prior art, because it prevents unintentional openings of the latch, and it maintains the clip in a closed, latched position, capable of sealing an ice bag even upon breakage of the hinge.

It is an object of this invention to provide a clip which is more reliable than prior art clips, particularly with respect to maintaining closure of the clip upon accidental bumping of the latch and reducing or negating the adverse effects upon the integrity of the clip should the hinge fail.

BRIEF DESCRIPTION OF THE DRAWINGS

For a more complete understanding of the present invention, and the advantages thereof, reference is now made to the following descriptions taken in conjunction with the accompanying drawings in which:

FIG. 3 is an enlarged partial cutaway side view of the hinge end of the FIG. 2 clip.

FIG. 4 is an enlarged partial cutaway side view of the latch end of the FIG. 2 clip.

FIG. 5 shows the interlocking of the nub and stops which serve to prevent longitudinal movement of the blade within the trough.

FIG. 6 shows the back section of the trough at the hinge end.

DETAILED DESCRIPTION OF EXEMPLARY EMBODIMENTS

The preferred embodiments of the present invention and its advantages are best understood by referring to FIGS. 1–6 of the drawings, like numerals being used for like and corresponding parts of the various drawings.

Figure 1:
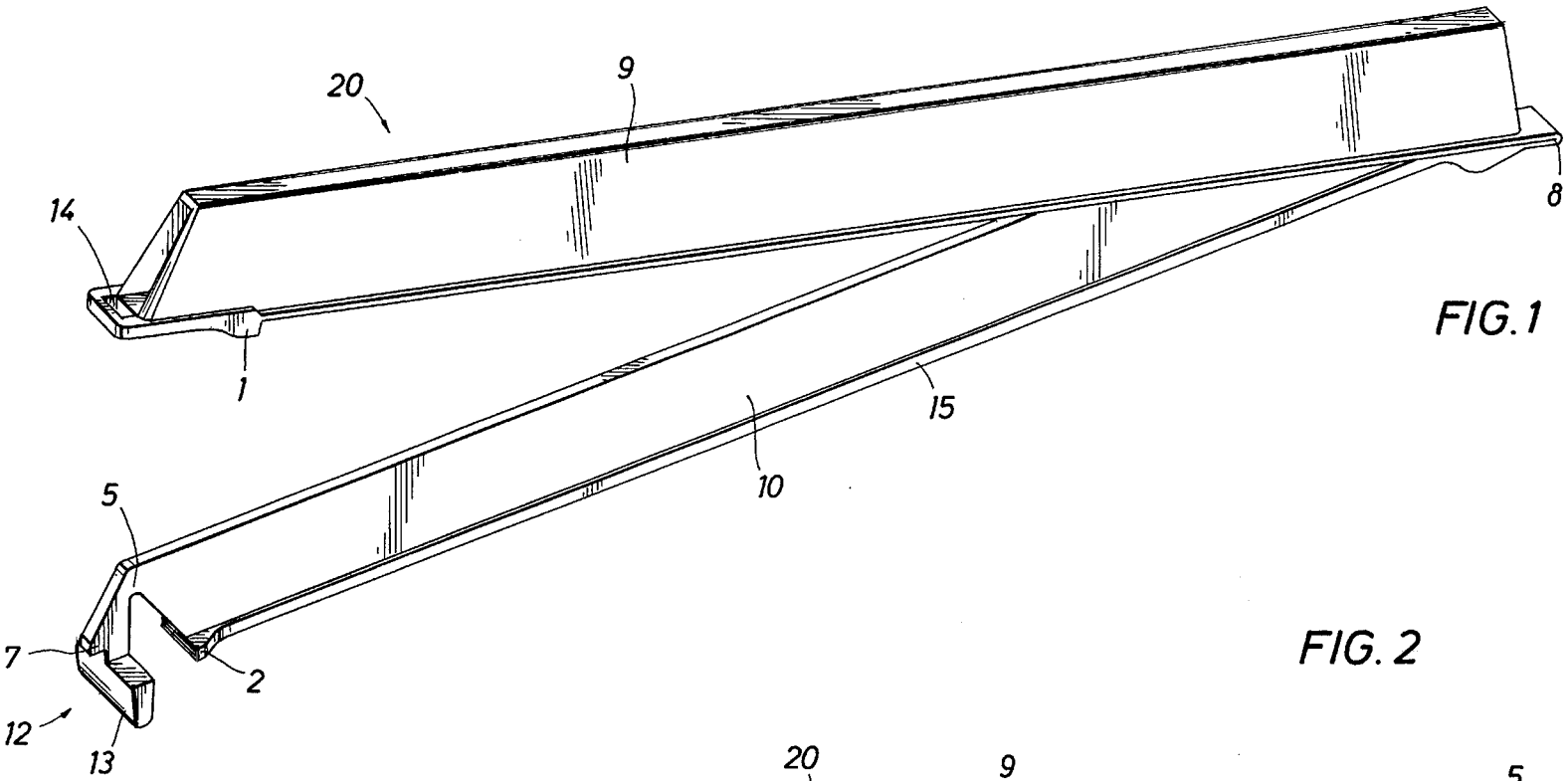
FIG. 1 is a side view of an open clip of the present invention.
Figure 2:
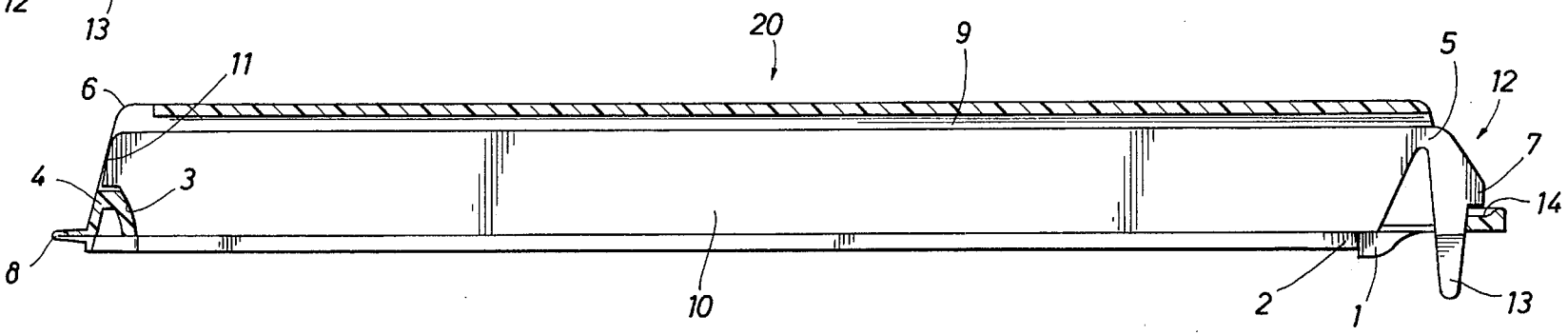
FIG. 2 is a side view in partial cutaway of a closed clip of the present invention.

FIGS. 1 and 2 show a clip 20 which is formed of six major components, a substantially planar blade 10, a trough 9, a hinge 8, a cam 4 with an interrelating cam follower surface 3 having a cam follower lock 16, a latch 12, and interlocking hubs 1 and stops 2.

The blade 10 is designed to fit within trough 9 such that when an ice bag (not shown) is interposed between the closed blade 10 and trough 9, the blade 10 and trough 9 cooperate to effectively seal the bag. The blade 10 and trough 9 are connected via a hinge 8 which is preferably a strap-like hinge, known in the art as a "living hinge".

As shown in FIGS. 2 and 3, the hinge end of the trough 9 has an inwardly projecting cam 4 and the blade 10 has a cam follower surface 3, designed to mate with and follow the cam 4. The cam 4 holds the blade 10 in a longitudinal position with respect to the trough 9 and prevents the blade 10 from moving to the left as shown in FIGS. 2 and 3. By interaction of the hinge 8, cam 4, and cam follower surface 3, the cam 4 exerts a force on blade 10 which tends to push blade 10 toward the right as shown in FIGS. 2 and 3.

The clip 20 has a latch 12 for releasably fastening the clip 20 in a closed position. FIGS. 2 and 4 show the latch 12 in a closed position. To open the latch 12, the user would push latch release knob 13 to the left as shown in FIGS. 2 and 4, such that the latch 12 bends at latch neck 5 and latch protrusion 7 clears latch notch 14 and the blade 10 can be removed from the trough 9.

As shown in FIG. 3, the cam 4 has a cam substantially flat surface 17 and the cam follower surface 3 has a cam follower lock 16. As can be seen, the cam substantially flat surface 17 and the cam follower lock 16 cooperate to prevent the blade 10 hinge end from moving perpendicular to the trough 9 hinge end (to prevent the blade 10 hinge end from moving downward as shown in FIG. 3), while permitting the blade 10 hinge end to move pivotally (via hinge 8) in relation to the trough 9 hinge end. The cam substantially flat surface 17 and the cam follower lock 16 serve several functions. Primarily, they prevent the blade 10 hinge end from moving out of the trough 9 hinge end upon failure of the hinge 8. Also, under normal use with the hinge 8 intact, they serve to provide additional stability at the hinge end and reduce stresses upon the hinge 8.

In a preferred embodiment, near the latch end of the trough 9 are included nubs 1 which preferably project in a direction toward the blade 10 of clip 20 in the open position. Near the latch end of blade 10 are included stops 2 which preferably extend in a lateral direction from the blade 10. While this preferred embodiment is shown in FIGS. 1, 2, 4 and 5, the invention is not intended to be so limited. For example, it is also possible that the nubs 1 may project in a lateral direction and the stops 2 may extend in a direction toward the trough 9 of a clip 20 in the open position (not shown). Also, as an alternate embodiment to the nubs 1 and stops 2 located near the latch end of blade 10 and trough 9, the nubs 1 and stops 2 may be located at the hinge end of blade 10 and trough 9 (not shown) or at both the hinge end and the latch end of blade 10 and trough 9 (not shown). It is intended that this invention cover all means for preventing the blade 10 from moving longitudinally in relation to the trough 9 (as further discussed below) that one of skill in the art may design. As further examples, the mechanism for preventing longitudinal movement could consist of a hole in the flat upper portion (as shown in FIG. 1) of trough 9 with a mating pin on the flat upper portion (as shown in FIG. 1) of blade 10 (not shown). Likewise, a hole(s) or pin(s) could be located on the blade's 10 ridge 15 to cooperate with a corresponding hole(s) or pin(s) on the corresponding ridge on trough 9 (not shown). One of skill in the art could design embodiments including various mating projections, holes, hooks, etc. to prevent longitudinal movement of the blade 10 in relation to trough 9. It is intended that these embodiments are covered by this patent. For each of these embodiments, it is preferred that the mechanism for preventing longitudinal movement be located at either the hinge end or the latch end of the blade 10 and trough 9 so as to not pinch or puncture the bag (not shown) when it is interposed between and in the center section of the blade 10 and trough 9.

As shown particularly in FIG. 5, for the preferred embodiment, the nubs 1 and stops 2 cooperate to prevent the blade 10 from moving longitudinally in the direction of the latch 12. If desired, the combination of nubs 1 and stops 2 may serve as a secondary latch. Also if desired, the nubs 1 and stops 2 may have interacting serrated faces (see stop 2 of FIG. 1) to further enhance the effectiveness of the secondary latch. This secondary latch is formed via the interrelation of the cam 4 pushing the blade 10 in the direction of the latch 12 and the nubs 1 and stops 2 interacting so as to hold the blade 10 within the trough 9. As can be seen, the cam 4 and the curvature of cam follower surface 3 tend to push the blade 10 in the direction of the latch 12, and the nubs 1 and stops 2 may be designed to provide a snug fit to serve as a secondary latch which would hold the blade 10 within the trough 9 even without the benefit of latch 12.

Thus, depending upon the desired effect, the cam 4, cam follower surface 3, nubs 1 and stops 2 may be designed such that blade 10 is just prevented from moving longitudinally or, these elements may be designed to provide a more snug fit, where blade 10 locks into this position providing a secondary latch.

As stated above, the nubs 1 and stops 2 provide at least two functions. First, the nubs 1 and stops 2 prevent longitudinal movement of the blade 10 within the trough 9. This provides several advantages. The nubs 1 and stops 2 prevent longitudinal movement in the normal, closed position which could eventually loosen the seal or increase wear on the hinge 8. Also, the nubs 1 and stops 2 serve to hold the blade 10 in the desired longitudinal position even upon the breakage of hinge 8. With prior art devices, if the hinge should fail, the blade can move longitudinally within the trough in the direction of the latch, which may open the latch mechanism, resulting in an unintentional opening of the clip. The present invention avoids this problem as nubs 1 and stops 2 prevent the longitudinal movement of the blade 10 toward the latch 12 in the event the hinge 8 fails. Thus, with the present invention, if the hinge 8 fails, the blade 10 may not move in the direction of the latch 12 so as to open the latch 12.

Second, the interaction of nubs 1 and stops 2 may be used to provide a secondary latch, such that if latch 12 is accidentally bumped, particularly to the left as shown in FIGS. 2 and 4, the clip 20 will not unintentionally open, releasing the contents of the bag. With the prior art devices, unintentional openings of the clip have occurred when the latch has been accidentally bumped. In this situation, the force exerted by the bag between the blade and trough may be sufficient to at least partially open the clip. Use of the nubs 1 and stops 2 as a secondary latch overcomes this shortcoming of the prior art devices.

The nubs 1, extending in a direction toward blade 10 when the clip 20 is in an open position, also serves to prevent a bag (not shown) from being caught in the latch 12 upon the initial closure of the clip 20.

The hinge end of the trough 9 includes a slot 6 which serves as a window to view shoulder 11 of blade 10. One purpose of slot 6 is to provide a visual indication, upon closure of the clip 20, that the bag (not shown) has not been placed to extend over the shoulder 11 of blade 10. It is desired that the bag not extend over the shoulder 11, and this situation would preferably be corrected by the user, since this could lead to undesired stresses on hinge 8 or a potential source of leakage of the bag even through a closed clip 20. The shoulder 11 preferably does not extend through slot 6, as this could lead to a pinching of the bag, resulting in a tear that could leak in the immediate use or subsequent uses.

The blade 10 has a perpendicular ridge 15 which serves to direct the bag in a perpendicular direction relative to the planar surface of blade 10 when the bag is sealed in the clip 20. The stops 2 may be formed as an integral part of the perpendicular ridge 15 near the latch end of blade 10.

The ice pack clip 20 solves the problems mentioned above by providing a clip 20 wherein the blade 10 is longitudinally stabilized relative to the trough 9. The combination of cam 4 with cam substantially flat surface 17, cam follower surface 3 with cam follower lock 16, nubs 1 and stops 2 hold the blade 10 in a stable state relative to trough 9 and provide for sealing a bag even if hinge 8 fails. Also, the nubs 1 and stops 2 may serve as a secondary latch which prevents accidental opening of the clip 20 upon bumping the latch release knob 13.

Although the present invention and its advantages have been described in detail, it should be understood that various changes, substitutions, and alterations can be made therein without departing from the spirit and scope of the invention as defined by the appended claims.

What is claimed is:

1. A closure device, comprising:

a substantially planar blade having a blade hinge end and a blade latch end;

a trough having a trough hinge end and a trough latch end;

a hinge pivotally connecting the blade hinge end and the trough hinge end;

a latch for releasably attaching the blade latch end and the trough latch end;

wherein the trough hinge end has an inwardly projecting cam and the blade hinge end has a cam follower surface;

wherein the blade latch end has at least one extending stop and the trough has at least one projecting nub near the trough latch end;

wherein the cam, the cam follower surface, the at least one nub and the at least one stop are designed to prevent longitudinal movement of the blade in relation to the trough; and wherein the cam, the cam follower surface, the at least one nub and the at least one stop are further designed as a secondary latch.

2. The closure device of claim 1, wherein the at least one nub and the at least one stop have interacting serrated faces.

3. A closure device, comprising:

a substantially planar blade having a blade hinge end and a blade latch end;

a trough having a trough hinge end and a trough latch end;

a hinge pivotally connecting the blade hinge end and the trough hinge end;

a latch for releasably attaching the blade latch end and the trough latch end;

wherein the trough hinge end has an inwardly projecting cam and the blade hinge end has a cam follower surface;

wherein the blade latch end has at least one extending stop and the trough has at least one projecting nub near the trough latch end;

wherein the cam, the cam follower surface, the at least one nub and the at least one stop are designed to prevent longitudinal movement of the blade in relation to the trough; and wherein the cam has a cam substantially flat surface and the cam follower surface has a cam follower lock, and wherein the cam substantially flat surface and the cam follower lock cooperate to prevent the blade hinge end from moving perpendicular to the trough hinge end while permitting the blade hinge end to move pivotally in relation to the trough hinge end.

4. A closure device, comprising:

a substantially planar blade having a blade hinge end and a blade latch end;

a trough having a trough hinge end and a trough latch end;

a hinge pivotally connecting the blade hinge end and the trough hinge end;

a latch for releasably attaching the blade latch end and the trough latch end;

wherein the trough hinge end has an inwardly projecting cam and the blade hinge end has a cam follower surface;

wherein the blade latch end has at least one extending stop and the trough has at least one projecting nub near the trough latch end;

wherein the cam, the cam follower surface, the at least one nub and the at least one stop are designed to prevent longitudinal movement of the blade in relation to the trough; and wherein the closure device is designed for releasably sealing a bag and wherein the trough hinge end has a slot and the blade hinge end has a shoulder to permit viewing the bag in the event the bag extends over the shoulder.

5. A closure device, comprising:

a substantially planar blade having a blade hinge end and a blade latch end;

a trough having a trough hinge end and a trough latch end;

a hinge pivotally connecting the blade hinge end and the trough hinge end; a latch for releasably attaching the blade latch end and the trough latch end;

means for preventing longitudinal movement of the blade in relation to the trough; and wherein the closure device is designed for releasably sealing a bag and wherein the trough hinge end has a slot and the blade hinge end has a shoulder to permit viewing the bag in the event the bag extends over the shoulder.

* * * * *

UNITED STATES PATENT AND TRADEMARK OFFICE

CERTIFICATE OF CORRECTION

PATENT NO. : 5,604,959

DATED : February 25, 1997

INVENTOR(S) : Bowen

It is certified that error appears in the above-indentified patent and that said Letters Patent is hereby corrected as shown below:

Title Page, item [56], line 5, delete "381,256", and insert -- 381,265 --.

Column 1, line 9, delete "hubs", and insert -- nubs --.

Column 2, line 44, delete "hubs", and insert -- nubs --.

Signed and Sealed this

Eighth Day of July, 1997

Bruce Lehman

*Attest:*

BRUCE LEHMAN

*Attesting Officer*

*Commissioner of Patents and Trademarks*